United States Patent [19]

Webinger

[11] 4,365,739

[45] Dec. 28, 1982

[54] TAKE-OUT CARTON WITH LOCKING COVER

[75] Inventor: George P. Webinger, Robbinsdale, Minn.

[73] Assignee: Champion International Corporation, Stamford, Conn.

[21] Appl. No.: 194,415

[22] Filed: Oct. 6, 1980

[51] Int. Cl.[3] ..... B65D 5/32

[52] U.S. Cl. ..... 229/32; 229/23 BT; 229/43

[58] Field of Search ..... 229/32, 23 R, 23 BT, 229/35, 45 R, 52 B, 43, 30, 41 R, 33, 34 R

[56] References Cited

U.S. PATENT DOCUMENTS

| | | | |
|---|---|---|---|
| 279,756 | 6/1883 | Heston | 229/32 |
| 1,096,118 | 5/1914 | Myers | 229/32 |
| 1,102,445 | 7/1914 | Schwab | 229/43 |
| 2,043,104 | 6/1936 | Labombarde | 229/32 |
| 2,085,458 | 6/1937 | Walker | 229/43 |
| 2,170,714 | 8/1939 | Ferguson | 229/43 |
| 2,545,802 | 3/1951 | Bergstein | 229/33 X |
| 2,859,906 | 11/1958 | Guyer | 229/43 |
| 3,010,638 | 11/1961 | Forrer | 229/45 |
| 3,058,578 | 4/1961 | Struble | 229/45 |
| 3,176,900 | 4/1965 | Ciganenko | 229/32 |
| 3,193,174 | 7/1965 | Glasband | 229/32 |
| 3,342,401 | 9/1967 | Kitchell | 229/35 |
| 3,863,832 | 2/1975 | Gordon et al. | 229/32 |
| 3,968,922 | 7/1976 | Ruud | 229/33 |
| 4,018,378 | 4/1977 | Persson | 229/43 |

FOREIGN PATENT DOCUMENTS

| | | | |
|---|---|---|---|
| 454022 | 1/1949 | Canada | 229/33 |

*Primary Examiner*—William Price
*Assistant Examiner*—Gary E. Elkins
*Attorney, Agent, or Firm*—Evelyn M. Sommer; John H. Mulholland

[57] ABSTRACT

A rectangular take-out carton which includes a flanged tray and tapered locking cover is disclosed. The tray flanges along the opposed sides are outwardly and downwardly extending and have an outward and upward bias which locks them behind and in edge-to-edge engagement with folded back and secured marginal portions of the associated side closure panels of the cover which are normally biased laterally inwardly. The end flanges of the tray are outwardly and downwardly extending for engagement with downwardly extending tapered end closure panels of the cover to provide a carrying flange and closure combination which creates a thermal seal and permits the weight of the carton and its contents to be supported thereby. The cover lock is released by pushing down and pivoting the cover side closure panels outwardly against their normal bias to free the folded back marginal portions from their edge-to-edge contact with the opposed outwardly and upwardly biased side wall flanges of the tray.

7 Claims, 5 Drawing Figures

TAKE-OUT CARTON WITH LOCKING COVER

BACKGROUND OF THE INVENTION

This invention relates to a new and improved take-out carton and comprises a tray and a cover for the tray and blanks for forming the same. The blanks are planar sheets of paper-board which are folded and secured into a flanged tray and a tapered cover for locking engagement therewith. The blanks and resulting cover and tray may be made of plastic or materials other than paperboard, if desired. The primary purpose of the take-out container of the invention is for transport of hot food items such as those served by fast food establishments.

The carton of the invention is preferably of a rectangular shape. The tray of the carton of the invention has four flanges all of which are outwardly and downwardly directed and are hingedly connected by means of a common fold line to the top of an associated side or end wall of the tray. The fold lines connecting the flanges to their associated side panels create an upward and outward bias on the outwardly and downwardly directed tray flanges.

The cover for the tray is also of a rectangular shape and although it need not be dimensioned precisely to the tray, it is geometrically similar. The cover has two pairs of opposed tapered side walls or closure panels. The lower end of the pair of closure panels of greater length each have a folded back marginal portion secured to the inside thereof. The cover can then be pushed onto a tray such that the associated side flanges of the tray spring slightly upward and back into the indentation formed by the folded back marginal portion of the cover and the side closure panel thereby effectively fastening the cover to the tray.

To release the cover from the tray one grasps the center of the cover side closure panels or walls and pushes the cover down as he pivots and lifts the walls upwardly to allow the flanges of the tray to be released from their edge-to-edge engagement with the folded back marginal portions of the cover.

The end or closure panels of lesser dimension of the cover engage the end flanges of the tray to both aid in effective thermal sealing of the units and to provide a lifting area for the combined units since the cover cannot be released from the tray by lifting at these points. The flanges on the tray ends are of greater width than those along the tray side walls to provide a lifting surface attached directly to the tray itself so that the weight of the carton and its contents may be conveniently and safely supported thereby.

Various take-out cartons of the prior art have been utilized in which the cover is hingedly connected to the tray but this has not been entirely satisfactory since these covers have had a tendency to inadvertently flip down into the food during the user's meal. Furthermore, prior two-part take-out cartons have had the problem of insufficient locking and, therefore, there has been danger of a gust of wind removing the top, for example, when the carton is being carried from a take-out restaurant to an automobile. It has also been a problem in the prior art that take-out cartons necessarily have been supported in the area directly below their food containing cavities such that heat can be transferred directly to the transporter's fingers.

Accordingly, it is the object of this invention to provide an improved two-part take-out carton which provides an effective lock for the cover to the tray which is easily unlocked for total removal of the cover for easy access to the contents of the tray.

An additional object of the invention is an improved two-piece take-out carton in which when the cover is locked on the tray the combination of the cover and tray permit the weight of the carton and its contents to be supported at the ends thereof without the necessity of handling the bottom panel in the area adjacent hot food.

It is a still further object of the invention to provide a take-out carton from paperboard cover and tray blanks which is easy and inexpensive to manufacture but which provides an improved method of locking the cover to the tray and releasing the cover from the tray while providing a handle area so that the cover and tray may be lifted as a unit without unlocking the cover from the tray.

The invention provides a simple mechanical method for joining a flanged tray and tapered cover which accomplishes these objects and provides a thermal barrier to keep the carton contents hot.

BRIEF SUMMARY OF THE INVENTION

The take-out carton of the invention is formed from a tray and a cover, each of which is made from a single planar blank of paperboard. The tray has a bottom panel and a plurality of pairs of opposed upstanding side wall panels which define a closed side wall. At least one, but preferably four, opposed upstanding side wall panels of the tray have flanges connected thereto along their top edge which extend outwardly and downwardly. The cover has a shape geometrically similar to that of the carton and includes a top panel and a plurality of outwardly and downwardly extending tapered sides or side closure panels each corresponding to a side wall panel of the tray and defining a closed side of the carton with its corresponding side wall panel when the cover is locked in position on the tray. The side closure panels have flaps hingedly connected at their lower edge and folded back and secured upon the inside surface thereof in face-to-face engagement. Accordingly, when the cover is placed on the tray, the side wall panel flanges engage the folded back and secured flap edges on the inside of the cover to effect a lock of the cover to the tray.

The closure panel flaps are normally biased laterally inwardly and the side wall panel flaps are normally biased laterally outwardly. Thus, to unlock the cover and remove it from the tray it is merely necessary to push the cover down and pull the side closure panels of the cover outwardly, thereby releasing the flanges on the side walls of the tray and permitting separation of the cover from the tray.

The ends of the cover and tray are such that the tapered end closure panels of the cover engage downwardly and outwardly extending flanges on the tops of the end side walls of the tray to provide a carrying flange and closure combination which creates a thermal seal and permits the weight of the carton and its contents to be supported thereby.

DETAILED DESCRIPTION OF THE PREFERRED EMBODIMENTS

Figure 1:
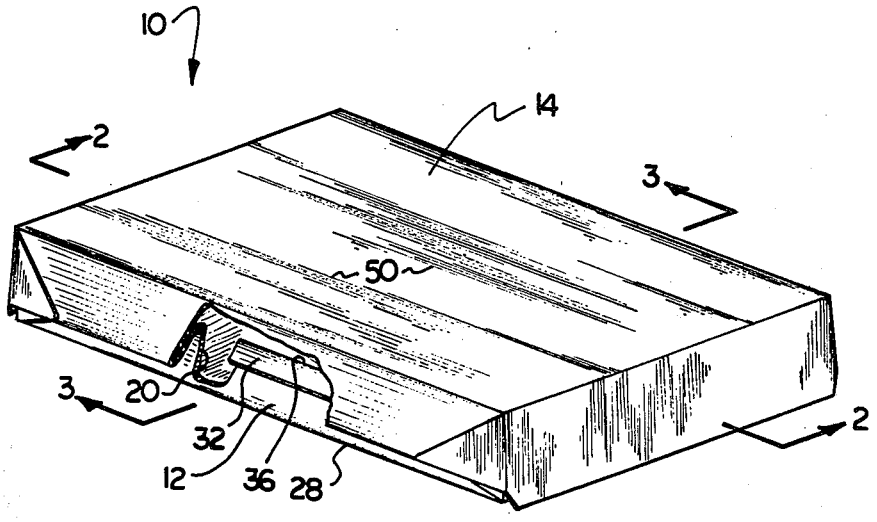
FIG. 1 is a perspective view of a carton including a cover and tray made in accordance with the principles of this invention.
Figure 2:
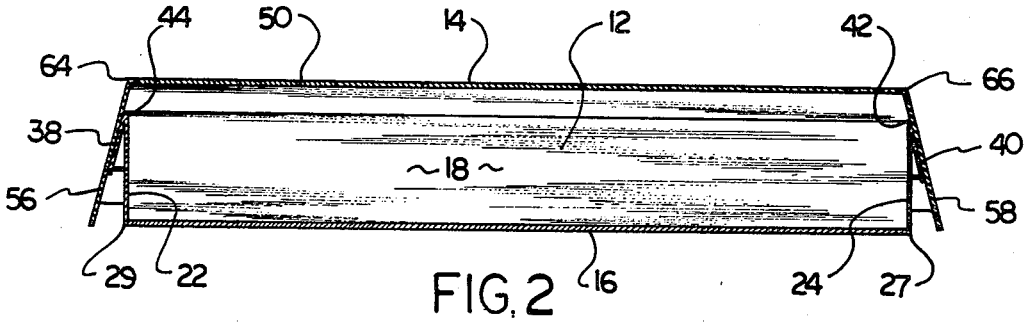
FIG. 2 is a cross-sectional elevational view taken along line 2—2 of FIG. 1.
Figure 3:
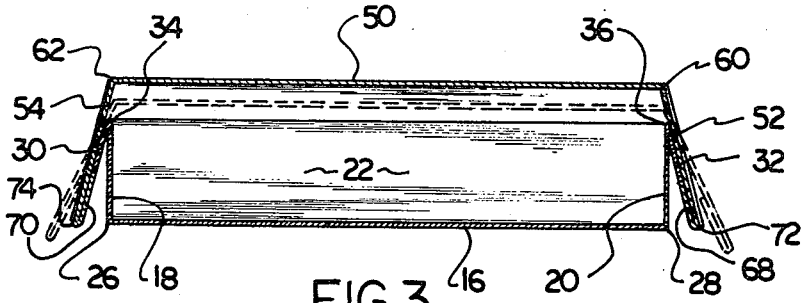
FIG. 3 is a cross-sectional elevational view taken along line 3—3 of FIG. 1.
Figure 4:
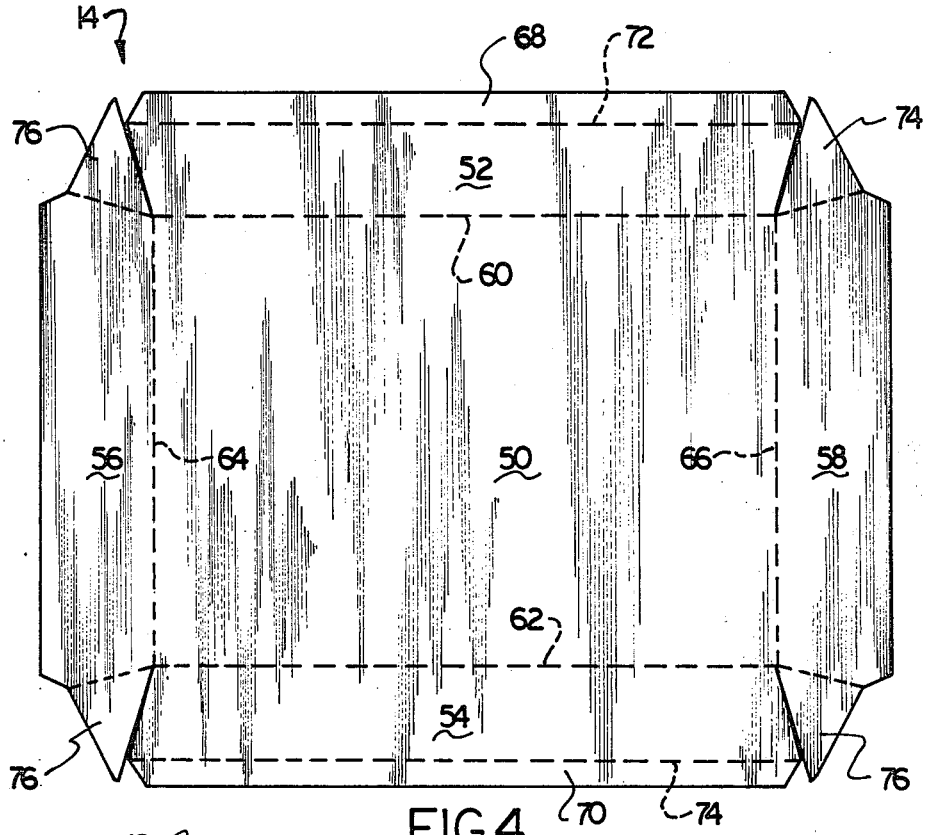
FIG. 4 is a plan view of the blank from which the tray cover of the carton of the invention is constructed.
Figure 5:
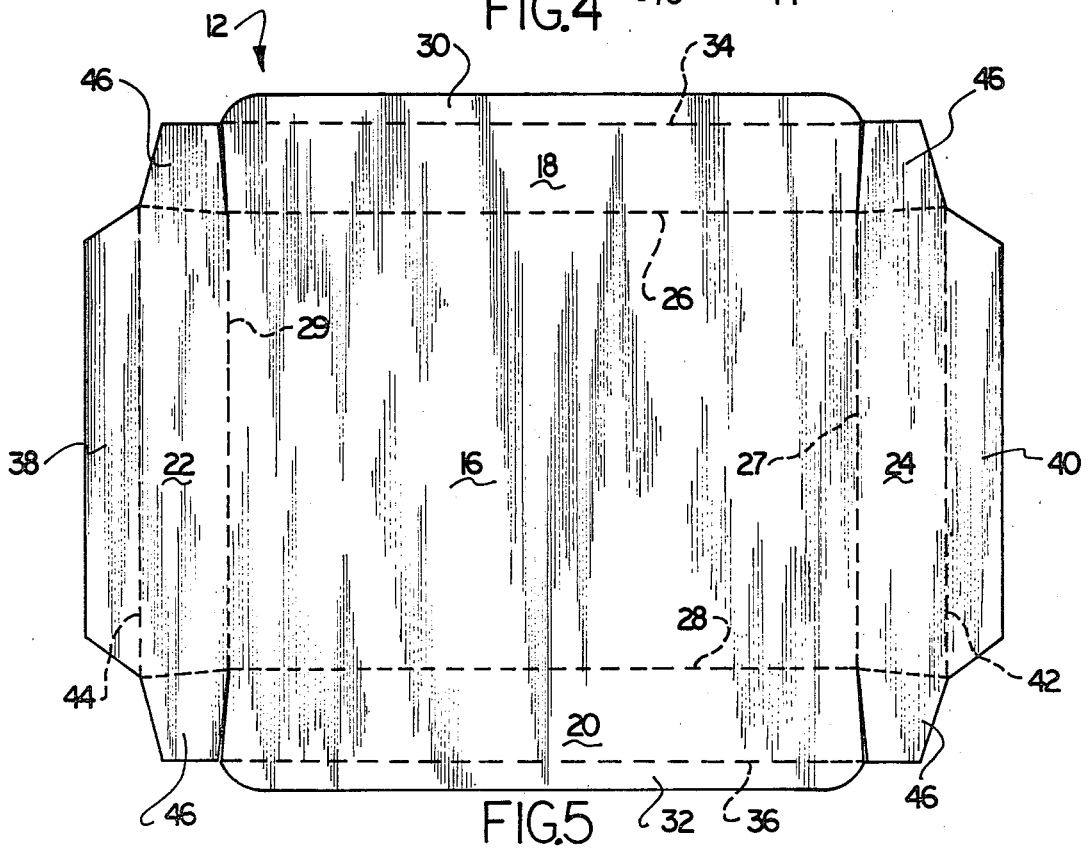
FIG. 5 is a plan view of the blank from which the tray of the carton of the invention is constructed.

The numeral 10 generally designates a take-out carton which includes a flanged tray 12 and a tapered locking cover 14. The tray 12 has a bottom panel 16 which is a polygonal shape, and in the illustrated embodiment, rectangular. A plurality of pairs of opposed upstanding side walls are hingedly connected to the bottom panel 16 and include side wall panels 18 and 20 as one opposed pair and side or end wall panels 22 and 24 as another opposed pair.

The opposed pairs of side wall panels 18 and 20 and 22, 24, respectively are hingedly connected to the rectangular bottom panel 16 by means of common fold lines 26, 27, 28 and 29. The pair of opposed side wall panels 18 and 20, hingedly connected by common fold lines 26 and 28 along the sides of rectangular bottom panel 16, have side wall panel flanges 30 and 32 hingedly connected along their top edges by means of common fold lines 34, 36. The side wall panel flanges 30 and 32, when the carton is erected, extend outwardly and downwardly for purposes which will be described hereinafter.

The other pair of opposed upstanding side wall panels 22 and 24, which for convenience may be described as end wall panels since they are connected respectively by common fold lines 27 and 29 with the ends of rectangular bottom panel 16, also have hingedly connected thereto, by means of common fold lines 42 and 44, outwardly and downwardly extending side or end panel flaps 38 and 40.

Attached to the opposed upstanding side or end wall panels 22, 24 of the tray 12 at the ends thereof, hingedly connected by means of common fold lines, are corner flaps 46 which overlap and are glued to the opposed pair of side wall panels 18 and 20 in conventional manner to define the tray 12 with its upstanding side wall panels defining a closed side wall made up of the side wall panels 18 and 20 and end side wall panels 22 and 24.

The cover 14 has a shape geometrically rectangular and similar to that of the tray 12. The tray 14 includes a top panel 50 and a plurality of pairs of opposed outwardly and downwardly extending side closure panels 52 and 54 along the longest dimension of the rectangle and 56, 58 along the end or shorter dimensions of the rectangle. The side closure panels 52 and 54 of the cover 14 are hingedly connected by means of common fold lines 60 and 62 to the top panel 50 and the pair of opposed end closure panels 56 and 58 at the ends of the rectangular top panel 50 are hingedly connected thereto by means of common fold lines 64 and 66. The opposing pair of outwardly and downwardly extending side closure panels 52, 54 have flaps 68 and 70, respectively, hingedly connected by means of common fold lines 72 and 74. The flaps 68 and 70 are folded back and glued in face-to-face engagement with the inside surfaces of the side closure panels 52, 54 to define a locking ledge structure for engagement with the lower edges of the flaps 30 and 32 of the tray 12.

When the cover 14 is assembled, the ends of the outwardly and downwardly extending side closure panels 56 and 58 are provided with closure tabs 76 which are glued in overlapping relationship to the adjacent ends of the opposed outwardly and downwardly extending side closure panels 52 and 54. With the cover 14 so assembled, it is merely telescopically pushed down over the erected tray 12 until the edges of the folded up and glued closure panel flaps 68 and 70 engage the edges of the side wall panel flanges 30 and 32, respectively, of the tray 12. This relationship occurs because the glued end closure flaps 76 of the cover 14 hold the closure panel flaps 68 and 70, and side closure panels 52 and 54 to which they are integrally associated and glued, normally biased laterally inwardly. Therefore, since side wall panel flanges 30 and 32 of the tray 12 are normally biased laterally outwardly and upwardly about their common fold lines 34 and 36 due to the memory of the paperboard or material from which they are constructed, a locking engagement is formed.

At the ends of the rectangle defined by the carton and tray combination, the downwardly and outwardly extending side wall panel flanges 38 and 40 of tray 12, which are also outwardly and upwardly biased, directly engage the second or end pair of opposed outwardly and downwardly extending side closure panels 56 and 58. Since the side closure panels 56 and 58 are greater in transverse dimension than panels 52 and 54, and are biased inwardly and are in engagement with the flanges 38 and 40, together they provide a carrying flange and closure combination which creates a thermal seal and permits the weight of the carton and its contents to be supported thereby without the necessity of grasping the bottom panel 16 of the tray 12.

To open the carton and remove cover 14 it is merely necessary to push the cover 14 downwardly until the edge contact of the folded back closure panel flaps 68 and 70 and the side wall panel flanges 30 and 32 are separated and then pull laterally outwardly on the cover side closure panels 52 and 54 until they are cleared of flanges 30 and 32 and lift the cover 14 upwardly.

What is claimed is:

1. In a food take-out carton comprising a tray and a cover for said tray:

said tray having a bottom panel and a plurality of pairs of opposed upstanding side wall panels defining a closed side wall;

at least one of said opposed upstanding side wall panels having a side wall panel flange hingedly connected thereto along its top edge and extending outwardly and downwardly;

said cover having a shape similar to that of said tray and including a top panel and a plurality of pairs of opposed outwardly and downwardly extending side closure panels each corresponding to a side wall panel of said tray and defining a closed side of said carton with its corresponding side wall panel;

at least the side closure panel associated with said one upstanding side wall panel having a closure panel flap hingedly connected to its lower edge along substantially the entire length thereof and folded back upon the inside surface of said side closure panel in face to face engagement therewith such that it engages and holds the side wall panel flange.

2. The carton of claim 1 in which the side closure panel flap and the side wall panel flange engage in an edge-to-edge relationship.

3. The carton of claim 2 in which the side closure panel flap is normally biased laterally inwardly and said side wall panel flange is normally biased laterally outwardly.

4. The carton of claim 1 in which a pair of opposed upstanding side wall panels both have said side wall panel flanges and both of said side wall panel flanges have side closure panels associated therewith with said closure panel flaps to engage and hold the respective adjacent side wall panel flanges.

5. The carton of claim 4 in which the carton is rectangular and said pair of opposed upstanding side wall panels associated with said pair of opposed side closure panel flaps extends along the greater dimension of the carton side wall and a second pair of opposed upstanding side wall panels extends along the lesser dimension of the carton side wall and has associated therewith a second pair of opposed side panel flanges hingedly connected to the upper edges thereof and extending downwardly and outwardly for engagement with a second pair of opposed outwardly and downwardly extending side closure panels on said cover.

6. The cover of claim 5 in which the second pair of opposed side panel flange are biased outwardly and said second pair of opposed outwardly and downwardly extending side closure panels on said cover are biased inwardly and in engagement therewith to provide a carrying flange and closure combination which permits the weight of the carton and its contents to be supported thereby.

7. The carton of claim 1 in which the closure panel flap is secured in face-to-face engagement with the inside surface of the side closure panel by means of adhesive, heat seal, microwave, or such other device common to the sealing of plain or poly-laminate paperboard.

* * * * *